US005623983A

United States Patent [19]

Thöne et al.

[11] Patent Number: 5,623,983

[45] Date of Patent: Apr. 29, 1997

[54] CONTINUOUS CASTING MOLD

[75] Inventors: Heinrich Thöne, Losenstein; Franz Wimmer, Riedau, both of Austria

[73] Assignee: Voest-Alpine Industrieanlagenbau GmbH, Linz, Austria

[21] Appl. No.: 574,392

[22] Filed: Dec. 18, 1995

[30] Foreign Application Priority Data

Dec. 21, 1994 [AT] Austria ..... 2380/94

[51] Int. Cl.[6] ..... B22D 11/04; B22D 11/16

[52] U.S. Cl. ..... 164/416; 164/418; 164/154.1

[58] Field of Search ..... 164/416, 418, 164/459, 478, 452, 154.1

[56] References Cited

U.S. PATENT DOCUMENTS 4,703,789 11/1987 Reichelt et al. ..... 164/154.1

FOREIGN PATENT DOCUMENTS 333997 12/1976 Austria .
355242 2/1980 Austria .
383521 12/1985 Austria .
0150357 12/1984 European Pat. Off. .
0570935 5/1993 European Pat. Off. .
0649242 10/1994 European Pat. Off. .
1758982 9/1968 Germany .
2248066 9/1972 Germany .
3227132 7/1982 Germany .
3543790 12/1985 Germany .
4023672 7/1990 Germany .

*Primary Examiner*—Joseph J. Hail, III
*Assistant Examiner*—L.-H. Lin
*Attorney, Agent, or Firm*—Ostrolenk, Faber, Gerb & Soffen, LLP

[57] ABSTRACT

A continuous casting mold having side walls through which a coolant flows includes a hydraulically operated oscillation device and a guiding device supporting the continuous casting mold relative to a stationary supporting structure. In order to do with a structurally very simple oscillation device having slight masses to be moved and to markedly reduce the space required by the oscillation device in the vicinity of the continuous casting mold, the oscillation device includes a pulsator setting the coolant into a pulsating pressure course and a supporting device is provided between the continuous casting mold and the stationary supporting structure, resiliently acting in accordance with the pulsating pressure course of the coolant and absorbing oscillation forces.

9 Claims, 1 Drawing Sheet

CONTINUOUS CASTING MOLD

BACKGROUND OF THE INVENTION

The invention relates to a continuous casting mold comprising side walls through which a coolant flows, a hydraulically operated oscillation means and a guiding means supporting the continuous casting mold relative to a stationary supporting structure.

A continuous casting mold of this type is known from DE-A-35 43 790. There, several pressure medium cylinders are provided, which are actuated in a pulsating manner thus causing the lifting table of the mold to reciprocate.

From AT-B-383.521 it is known to form the oscillation means of eccentric shafts which are driven by corner gears and engage at the corners of the rectangular lifting table via articulation brackets, thus setting the lifting table in vertically directed oscillations. By aid of that oscillation means the weight forces of the continuous casting mold are introduced into the stationary supporting structure surrounding the continuous casting mold.

To precisely guide the continuous casting mold in the vertical direction or, with the continuous casting mold being designed as a curved mold, in the direction of the curved strand axis, AT-B-383.521 provides for a spring carrier equipped with a single-or multi-layer diaphragm spring, which is connected with the continuous casting mold on the one hand and with the stationary supporting structure on the other hand. That diaphragm spring transmits into the stationary supporting structure any possible lateral forces occurring.

From AT-B-333.997 and AT-B-355.242 it is, furthermore, known to set a continuous casting mold into vertically reciprocating oscillations by means of a pivotably movable lever, which lever is movable by means of an eccentric drive according to AT-B-333.997 and AT-B-355.242. Also there, the structural expenditures for the oscillation means are very high, since a two-arm lever that has to carry the weight of the continuous casting mold must be provided and additionally set in motion.

SUMMARY OF THE INVENTION

The invention aims at further developing continuous casting molds of the initially defined kind with a view to being able to do with a structurally very simple oscillation means. In particular are the moved masses of the oscillation means to be substantially reduced and the space required by the oscillation means in the vicinity of the continuous casting mold to be markedly diminished. Moreover, the structure according to the invention is to be substantially less prone to failures, in particular is the oscillation means to be able to operate without being disturbed by the rough casting operation by its drive mechanism being arrangeable in a well protected manner.

In accordance with the invention, this object is achieved in that the oscillation means comprises a pulsator setting the coolant into a pulsating pressure course and that a supporting means is provided between the continuous casting mold and the stationary supporting structure, resiliently acting in accordance with the pulsating pressure course of the coolant and absorbing oscillation force.

According to a preferred embodiment, the supporting means is comprised of at least one pressure medium cylinder through which the coolant flows or of a bellow cylinder through which the coolant flows.

Preferably, the pulsator comprises a pump setting the coolant under pressure, in particular a centrifugal pump, and an adjustable throttle, the throttle being alternately switchable between two throttle positions.

According to a further preferred embodiment, the pulsator is comprised of a piston-pump system for conveying a predetermined basic amount of coolant as well as of an additionally provided controllable reciprocating pump for imparting the pulsating pressure course to the coolant. The piston-pump system may comprise a multiple cylinder pump, one of the cylinders of the multiple cylinder pump being controllable to generate the pulsating pressure course of the coolant.

According to the invention, the pulsator suitably is arranged at a great distance from the continuous casting mold such that the pulsator may not only be well protected against influences from the casting region, but also arranged where sufficient space is available thus leaving free the space around the continuous casting mold which is constricted, anyway. Suitably, the pulsator is provided in a separate room of the casting hall, which is called "media room".

A particularly cost-saving structure results if a single pulsator serves to generate a pulsating pressure course of the coolant for two or several continuous casting molds.

Preferably, the guiding means is comprised of two disc-shaped springs peripherally surrounding the continuous casting mold and connected both with the continuous casting mold and with the stationary supporting structure in a liquid-fight manner, the space provided between the disc-shaped springs being permeated by coolant and the disc-shaped springs having different spring constants. In this embodiment, the guiding means performs two functions simultaneously, namely the exact guidance of the continuous casting mold in the reciprocating direction, on the one hand, and the application of reciprocation forces (i.e., lifting forces) as well as the absorption of the weight forces of the continuous casting mold, on the other hand.

BRIEF DESCRIPTION OF THE DRAWINGS

Appended FIGS. 1 to 3 each schematically illustrate a cross section through a continuous casting mold according to one embodiment each.

DESCRIPTION OF THE PREFERRED EMBODIMENTS

Figure 1:
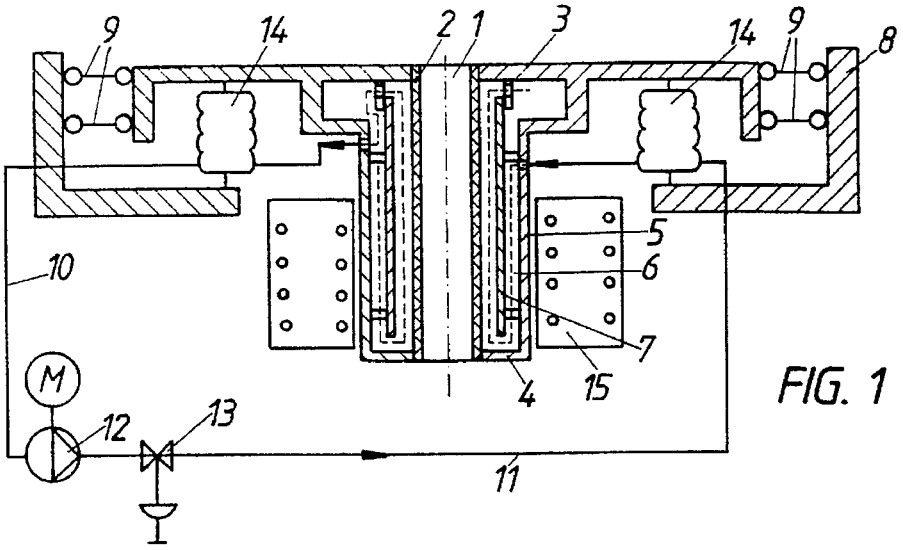

The continuous casting mold represented in FIG. 1 comprises an internal tube 2 of copper or a copper alloy defining a straight casting cavity 1 and having a cross section for casting a round or square or rectangular billet or bloom. The casting cavity 1 also could be curved. The internal tube 2 is liquid-tightly inserted in a top flange 3 (or mold top plate) by its upper end and in a bottom flange 4 by its lower end. Top and bottom flanges are connected with each other by a wall forming an external wall 5 of the continuous casting mold, a hollow space 6 being defined between the internal tube 2 and the external wall 5, through which a coolant flows and which surrounds the internal tube 2 peripherally. An intermediate wall 7 is inserted in this hollow space 6 such that the coolant is guided along the internal tube 2 for the purpose of intensively cooling the internal tube 2.

Between the top flange 3 and a stationary supporting structure 8 peripherally surrounding the continuous casting mold, a guiding means is provided, which is capable of absorbing the lateral forces derived from the continuous casting mold, allowing for a certain vertical movability of the vertically reciprocating continuous casting mold. This guiding means may be comprised of spring bands 9 as described, for instance, in EP-A-0 150 357 or DE-A-22 48 066, or of guide rods.

According to the embodiment represented in FIG. 1, the coolant circulatory system, which is diagrammatically illustrated by coolant discharge and feed lines 10, 11, comprises a centrifugal pump 12 setting the coolant under pressure, upon which an adjustable throttle 13 follows in the flow direction. This throttle is alternately switchable between two throttle positions such that the coolant is modulated a pulsating pressure course. Pressure and amount of water automatically adjust as a function of the characteristic line of the centrifugal pump between the two switch points of the adjustable throttle 13.

Between the stationary supporting structure 8 and the top flange 3 of the continuous casting mold, at least one or several supporting means 14 actuated by the pulsating pressure medium are provided, which are capable of absorbing the vertical forces occurring between the stationary supporting structure 8 and the continuous casting mold. According to the exemplary embodiment illustrated in FIG. 1, the supporting means 14 are designed as bellow cylinders. On account of the pressure fluctuations modulated to the coolant, a reciprocating movement of the continuous casting mold is obtained by aid of the bellow cylinders 14 expanding and retracting in accordance with the pressure fluctuations. The pressure fluctuations need not be that large, i.e., the amplitude of the pressure fluctuation is only low such that no inadmissible loads on the coolant circulatory system, i.e., the lines, pump, fittings, sealings, etc., will occur.

A particular advantage of the construction according to the invention is to be seen in that the pulsator, which is formed by the centrifugal pump 12 plus throttle 13, need not be arranged directly within the casting zone. Rather may it be housed in the media supply room of the continuous casting mold so as to be well protected and easily accessible. This also enhances the accessibility to the continuous casting plant, since the space in the immediate surroundings of the continuous casting mold is rather limited, anyway, by secondary aggregates, such as, e.g., agitation means 15.

Figure 2:
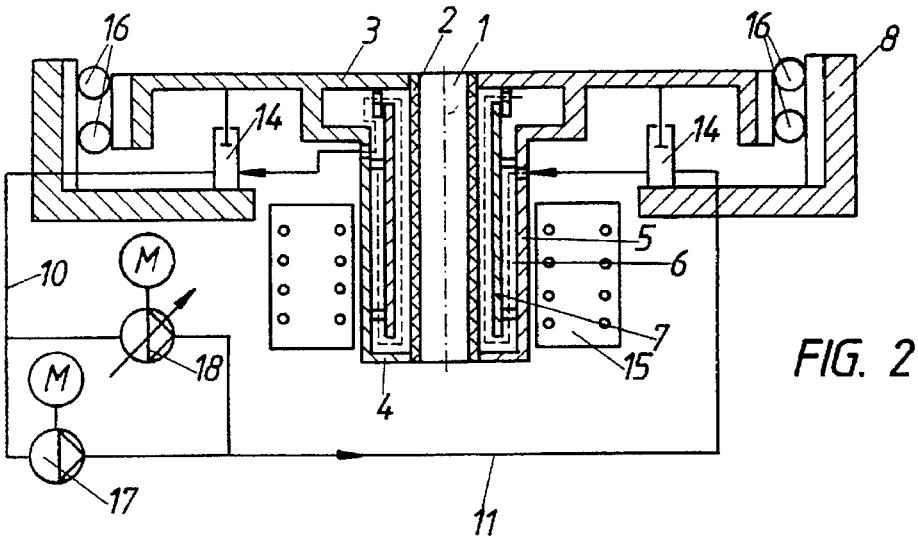

According to the embodiment represented in FIG. 2, the continuous casting mold is supported relative to the stationary supporting structure 8 by means of guide rollers 16 transmitting lateral guiding forces to the same. The bellow cylinders have been replaced with pressure medium cylinders 14. The pulsator in this embodiment is formed by a piston-pump system 17 adapted to convey a predetermined basic amount of coolant—that which is necessary for efficiently cooling the continuous casting mold—as well as an additionally provided controllable reciprocating pump 18 for generating the pulsating pressure course of the coolant.

The piston-pump system in this case may be comprised of a multiple cylinder pump, one of whose cylinders is controlled to impart the pulsating pressure course to the coolant according to the desired reciprocating movement of the continous casting mold.

Figure 3:
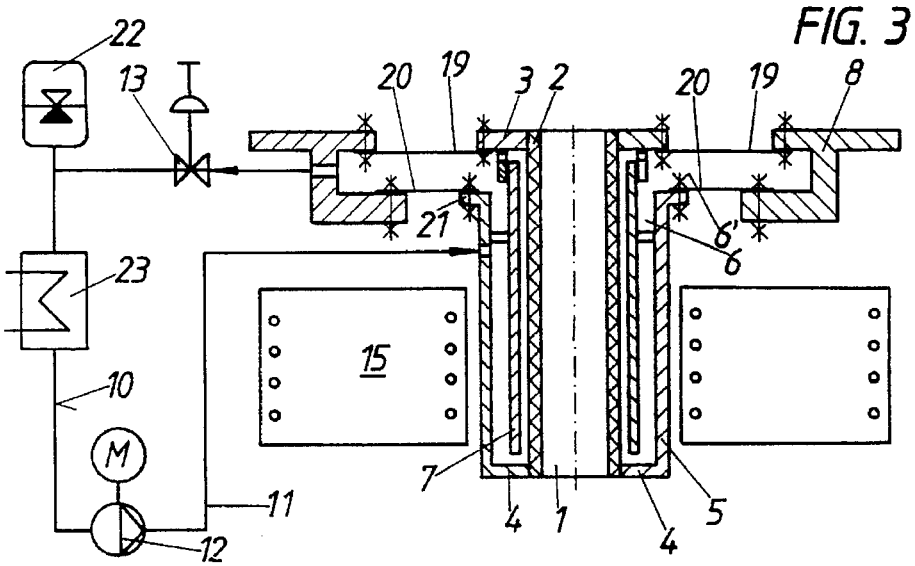

According to the embodiment represented in FIG. 3, the guiding means for absorbing the lateral guiding forces of the continous casting mold is comprised of two disc-shaped springs 19, 20 spaced apart vertically and designed as annular discs, each of the disc-shaped springs 19, 20 being connected with the stationary supporting structure 8 by their outer edge regions, for instance, by screw connections. The inner edge of the upper disc-shaped spring 19 is connected with the outer edge region of the top flange 3 of the continuous casting mold and the inner edge region of the lower disc-shaped spring 20 is connected with an annular flange 21 connected with the bottom flange 4 via the external wall 5. The connections between the disc-shaped springs 19, 20 and the pertaining flanges are liquid-tight.

Through the space 6' provided between the disc-shaped springs 19, 20 and communicating with the hollow space 6, a coolant flows which, analogous to the embodiment illustrated in FIG. 1, likewise has a pulsating pressure course. The latter is generated by means of a controllable throttle 13 and a pump 12 (preferably a centrifugal pump). Due to the spring constants of the two disc-shaped springs 19, 20 being unequal, the coolant subjected to these pressure fluctuations causes the continuous casting mold to carry out a reciprocating movement relative to the stationary supporting structure 8. The disc-shaped springs 19, 20 may be biassed for absorbing the weight forces of the continuous casting mold.

In order to ensure homogenous stressing in the corner regions of the disc-shaped springs 19, 20 (if shaped to deviate from a circular ring when viewed from above), zones of smaller cross section, i.e., slighter thickness, than the remaining zones of the disc-shaped springs advantageously are provided in the corner regions of the disc-shaped springs. There, slits may also be provided, which would have to be covered in a liquid-fight manner.

According to all of the embodiments, the coolant circulatory system is fed from a high-level reservoir 22 and comprises a heat exchanger 23 (shown in FIG. 3) carrying off the heat transmitted from the cast strand to the coolant.

In all of the embodiments, the casting cavity 1 may also be curved, wherein the arrangement of the disc-shaped springs 19, 20 in an embodiment according to FIG. 3 suitably is effected in planes that are oriented radially relative to the curved longitudinal central axis of the continuous casting mold.

The coolant fluctuations only negligibly affect the cooling performance as long as a minimum amount of coolant is not fallen short of. By taking measurements of the reciprocating movement of the continuous casting mold, any desired curve course (e.g., a non-sinusoidal course) may be followed via a control circuit not illustrated.

The continuous casting mold according to the invention may be used both for casting billets and blooms and for casting slabs. In the latter case, the continuous casting mold may be configured as a plate mold, if desired with adjustable side wall plates, instead of a tubular mold.

What we claim is:

1. In a continuous casting mold arrangement of the type including a continuous casting mold having side walls with a coolant flowing through said side walls, a hydraulically operated oscillation means, a stationary supporting structure and a guiding means constructed to support said continuous casting mold relative to said stationary supporting structure, the improvement wherein said oscillation means comprises a pulsator constructed to impart a pulsating pressure course to said coolant and a supporting means provided between said continuous casting mold and said stationary supporting structure, said supporting means being constructed to resiliently act in accordance with said pulsating pressure course imparted to said coolant and to absorb oscillation forces.

2. A continuous casting mold arrangement as set forth in claim 1, wherein said supporting means is comprised of at least one pressure medium cylinder through which said coolant flows.

3. A continuous casting mold arrangement as set forth in claim 1, wherein said supporting means is comprised of at least one bellow cylinder through which said coolant flows.

4. A continuous casting mold arrangement as set forth in claim 1, wherein said pulsator comprises a pump constructed to set said coolant under pressure and a throttle capable of being switched between a first throttle position and a second throttle position.

5. A continuous casting mold arrangement as set forth in claim 4, wherein said pump is a centrifugal pump.

6. A continuous casting mold arrangement as set forth in claim 1, wherein said pulsator is comprised of a piston-pump system constructed to convey a predetermined basic amount of coolant and an additionally provided controllable reciprocating pump constructed to impart said pulsating pressure course to said coolant.

7. A continuous casting mold arrangement as set forth in claim 1, wherein said pulsator is arranged at a great distance from said continuous casting mold.

8. A continuous casting mold arrangement as set forth in claim 1, wherein said pulsator serves for generating said pulsating pressure course of said coolant as a single pulsator for at least two continuous casting molds.

9. A continuous casting mold arrangement as set forth in claim 1, wherein said guiding means is comprised of two disc-shaped springs having different spring constants and spaced apart so as to leave a space therebetween for a coolant to flow therethrough, said two disc-shaped springs peripherally surrounding said continuous casting mold and being connected with both said continuous casting mold and said stationary supporting structure in a liquid-tight manner.

* * * * *